US005425319A

United States Patent [19]

Resta et al.

[11] Patent Number: 5,425,319

[45] Date of Patent: Jun. 20, 1995

[54] CLOTH FEEDING APPARATUS FOR QUILTING MACHINES

[75] Inventors: Roberto Resta; Mario Resta; Rodolfo Resta, all of Faenza, Italy

[73] Assignee: Resta S.r.l., Faenza, Italy

[21] Appl. No.: 92,638

[22] Filed: Jul. 16, 1993

[30] Foreign Application Priority Data

Jul. 29, 1992 [IT] Italy ..... BO92A0293

[51] Int. Cl.[6] ..... D05B 11/00

[52] U.S. Cl. ..... 112/118

[58] Field of Search ..... 112/266.1, 118, 303, 112/121.26; 38/143, 102.91

[56] References Cited

U.S. PATENT DOCUMENTS 3,500,777 3/1970 Kalning et al. .
3,960,095 6/1976 Story ..... 112/118
4,883,009 11/1989 Haselberger et al. ..... 112/118 X
5,022,336 6/1991 Iwase .
5,103,747 4/1992 Resta et al. ..... 112/117

FOREIGN PATENT DOCUMENTS 0087395 8/1983 European Pat. Off. .
0129043 12/1984 European Pat. Off. .
0220368 5/1987 European Pat. Off. .
0316267 5/1989 European Pat. Off. .
462962 4/1937 United Kingdom .

*Primary Examiner*—Clifford D. Crowder
*Assistant Examiner*—Paul C. Lewis
*Attorney, Agent, or Firm*—Guido Modiano; Albert Josif

[57] ABSTRACT

The apparatus has a pair of chains on which a bar is transversely fixed. The bar is provided with clamps for gripping the front edge of a cloth to be quilted. The chains move the cloth from a position for gripping its front edge to a quilting position, where it is transferred onto the clamps of a carriage which transfers the cloth onto a removal device.

10 Claims, 6 Drawing Sheets

CLOTH FEEDING APPARATUS FOR QUILTING MACHINES

BACKGROUND OF THE INVENTION

The present invention relates to an apparatus for feeding a quilting machine with a cloth to be quilted.

In the continuation of the description and in the claims, the term "cloth" is used to designate any single- or multiple-layer element perimetrically open or closed bag-like form.

In conventional quilting machines, which quilt individual cloths, each individual cloth is manually fixed onto a cloth supporting frame with a considerable waste of time.

SUMMARY OF THE INVENTION

A technical aim of the present invention is to provide, for feeding a quilting machine, an apparatus allowing to automatically take the cloth to be quilted from a feeder, then lay it on a surface to allow quilting thereof, and finally remove and transfer it towards a removal conveyor while a new cloth is delivered to the quilting machine.

Within the scope of this aim, an object of the present invention is to provide an apparatus which is structurally simple and safely reliable in operation.

With the foregoing and other objects in view, there is provided an apparatus characterized in that it comprises: a pair of flexible elements, closed in a loop along vertical planes and having two upper horizontal and parallel portions which are movable in a direction X; at least one bar fixed transversely to said flexible elements and provided with clamps for gripping the front edge of the cloth to be quilted; and means for actuating said flexible elements for the advancement of the cloth in said direction X from a position for gripping the front edge of the cloth to be quilted to a quilting position and from said quilting position to a position in which said clamps release said cloth on removal means; second clamps being arranged at the sides of said horizontal portions of said flexible elements in order to grip the lateral edges of said cloth and retain it in said quilting position.

BRIEF DESCRIPTION OF THE DRAWINGS

Further characteristics of the present invention will become apparent from the following description of a preferred embodiment thereof, illustrated only by way of non-limitative example in the accompanying drawings, wherein.

Figures 8, 9, 10:
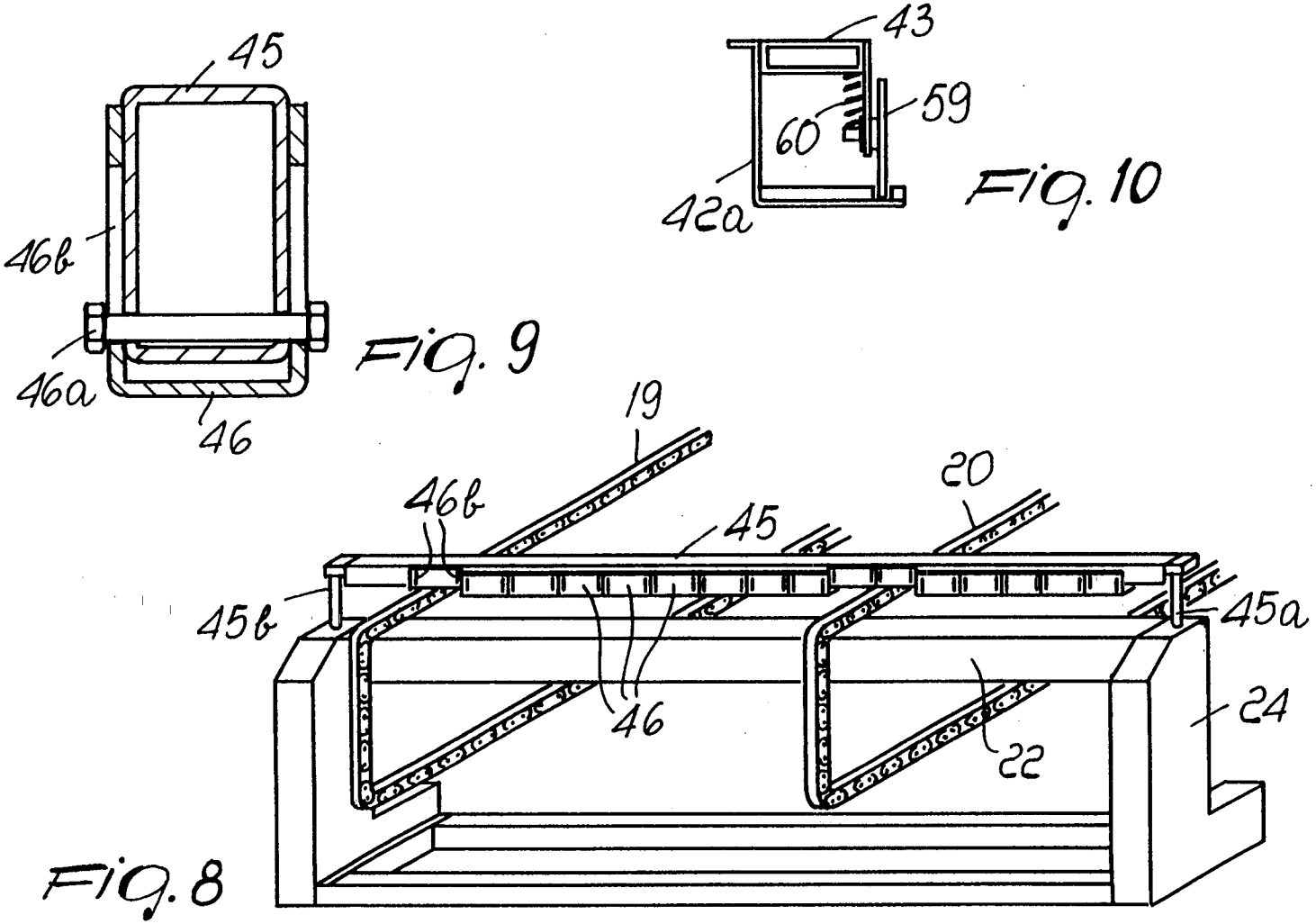
Figure 11:
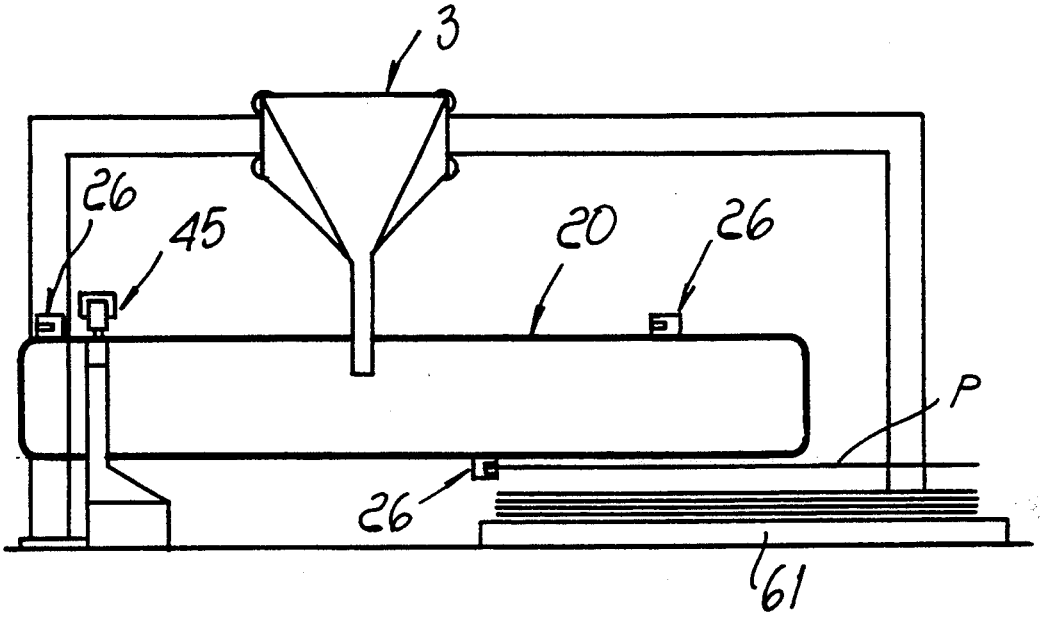
Figure 12:
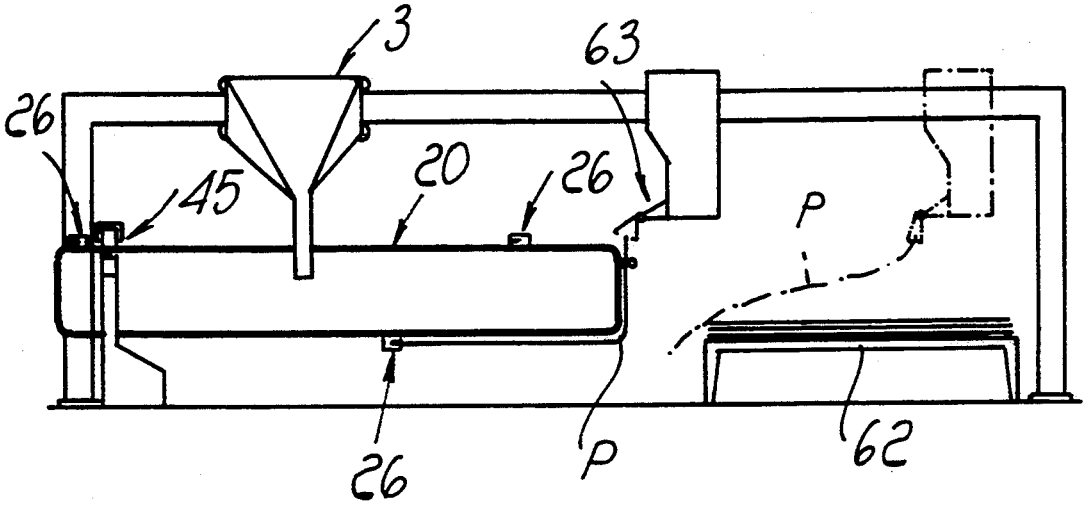

FIGS. *7a–7d* are views of the first and second clamps in different operating positions;

FIG. 8 is a perspective view of the means for the transverse retention of the cloth;

FIG. 9 is a view of a detail of the means of FIG. 8;

FIG. 10 is a view of a different embodiment of the means for the transverse retention of the cloth; and FIGS. 11 and 12 are two side views of two different embodiments of the apparatus.

DESCRIPTION OF THE PREFERRED EMBODIMENTS

With reference in particular to FIGS. 1 to 4, the reference numeral 1 designates a quilting machine composed of a framework 2 for supporting a carriage 3 which carries one or more conventional sewing machines (not shown).

The framework 2 is composed of four vertical posts 4, 5, 6 and 7 arranged at the corners of a rectangle. The posts 4, 5 and 6, 7 have upper ends which are mutually connected by a pair of longitudinal beams 8 and 9, and two transverse beams 10 and 11.

Two mutually parallel rail members 12 and 13 extend between the transverse beams 10, 11, and extend parallel to the longitudinal beams 8 and 9.

The carriage 3 is composed of a pair of horizontal lower and upper parallel beams, respectively indicated by the reference numerals 14, 15 (FIG. 2), which are located above and below the plane of arrangement of the cloth to be quilted. The horizontal beams 14, 15 have opposite ends which are mutually connected and are rigidly suspended from respective shoulders 16, 17. Rollers 18 are rotatably connected to the shoulders 16, 17 and rest on the rails 12, 13.

The carriage 3, by means of a conventional motorization unit such as, e.g., an electric motor and kinematic transmission means (not shown in the drawings) is movable back and forth along the rail 12, 13 in the direction X.

A head for moving the needle of a sewing machine is mounted on the upper beam 14; a crochet device of said sewing machine is mounted on the lower beam 15.

In a known manner, by means of a further conventional motor unit, not shown, the sewing machine, i.e. the head and the crochet device, is actuated in the direction Y which is at right angles to direction X, so that it is possible to produce a quilting line on the cloth along the desired path by actuating the carriage 3 and the sewing machine.

Figure 5:
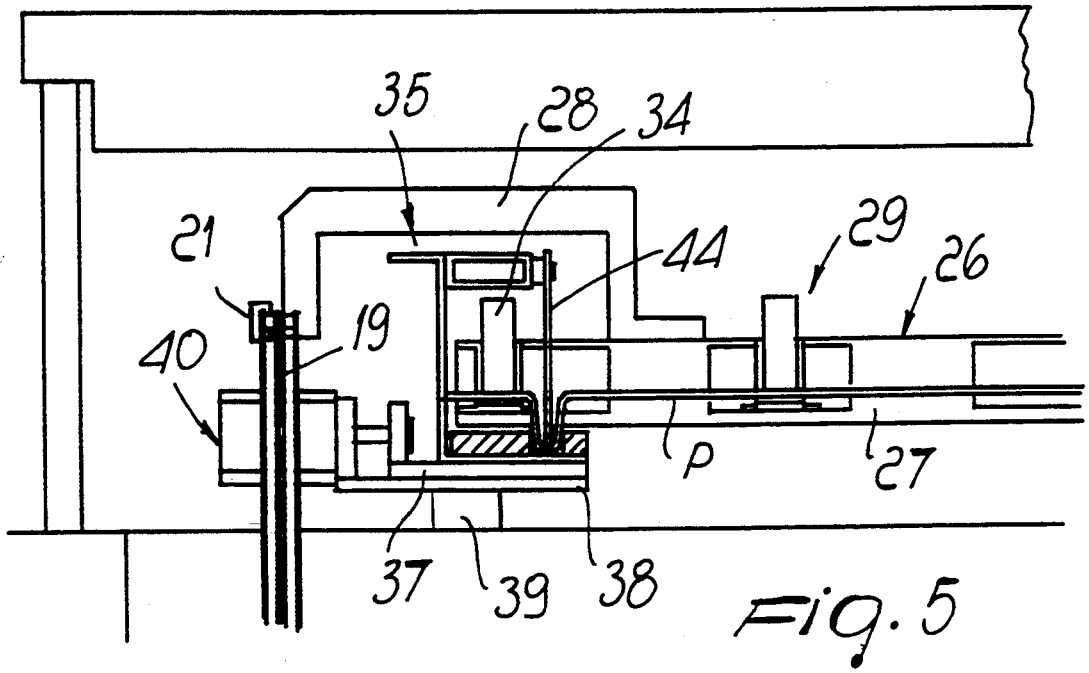
FIG. 5 is a front view of a constructive detail thereof.
Figure 7A:
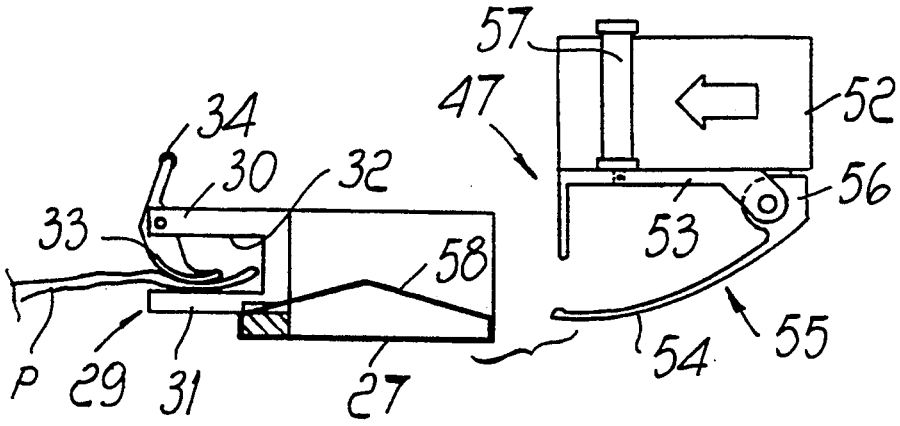
Figure 7B:
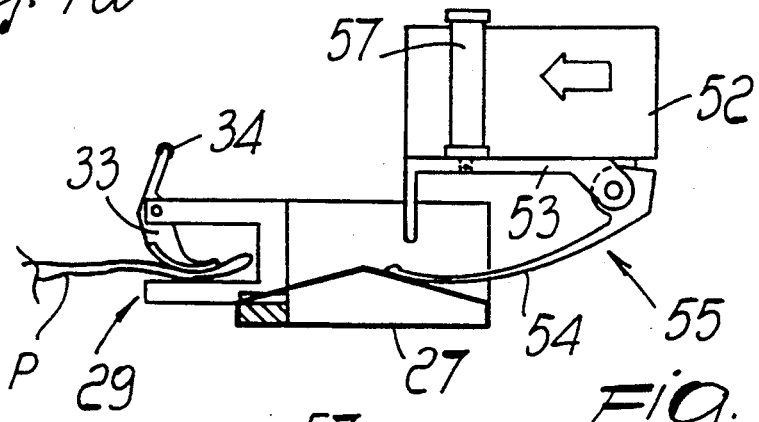
Figure 7C:
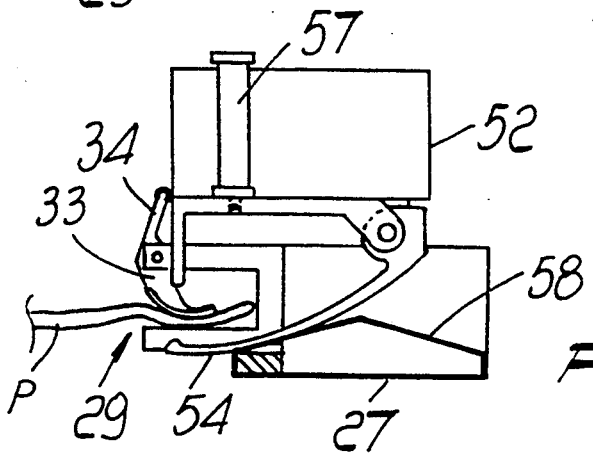
Figure 7D:
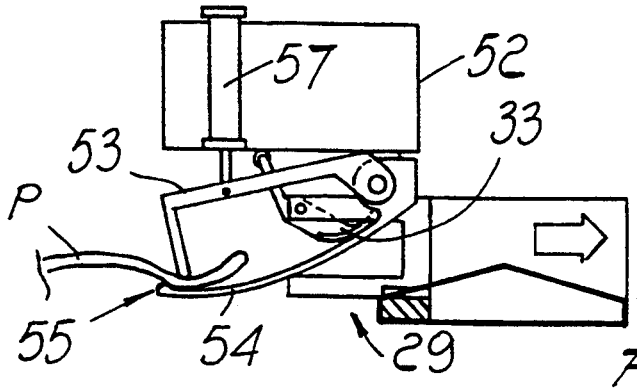

To take the cloth to be quilted, feed it below the sewing head and remove it after quilting, there is an apparatus composed of a pair of flexible elements 19 and 20 (FIGS. 1 and 8) which extend along a rectangular path, and means for actuating the flexible elements, shown schematically in FIG.2 and indicated by the reference numeral 100. More precisely, these flexible elements comprise two chains which are closed in a loop and have two upper horizontal and parallel portions extending between the beams 14 and 15 of the carriage 3. The two chains 19 and 20 run in respective guides 21 (see FIG. 5) which are fixed to a pair of beams 22 and 23 which are mounted at the top of supports 24 and 25 and are at right angles to direction X.

A bar 26 extends between the chains 19 and 20 and is composed of a straight portion 27 and of an arc-like portion 28 which connects the opposite ends of the portions 27 to the chains.

A plurality of first clamps 29 (see FIGS. *7a–7d*) is mounted on the portion 27; each clamp comprises a pair of superimposed brackets 30 and 31 protruding in a cantilevered manner from the bar 26 and forming a recess 32. An arc-shaped lever 33 is articulated to the end of each upper bracket 30, is kept in abutment against the lower bracket 31 by means of a spring (not shown), and forms a guide together with said lower bracket. The lever 33 furthermore has an arm 4 which rises from the bracket 30.

The first clamps 29 are distributed along the bar 26 and are provided to receive the front edge of a cloth P manually inserted between the levers 33 and the lower bracket 31.

Figure 6:
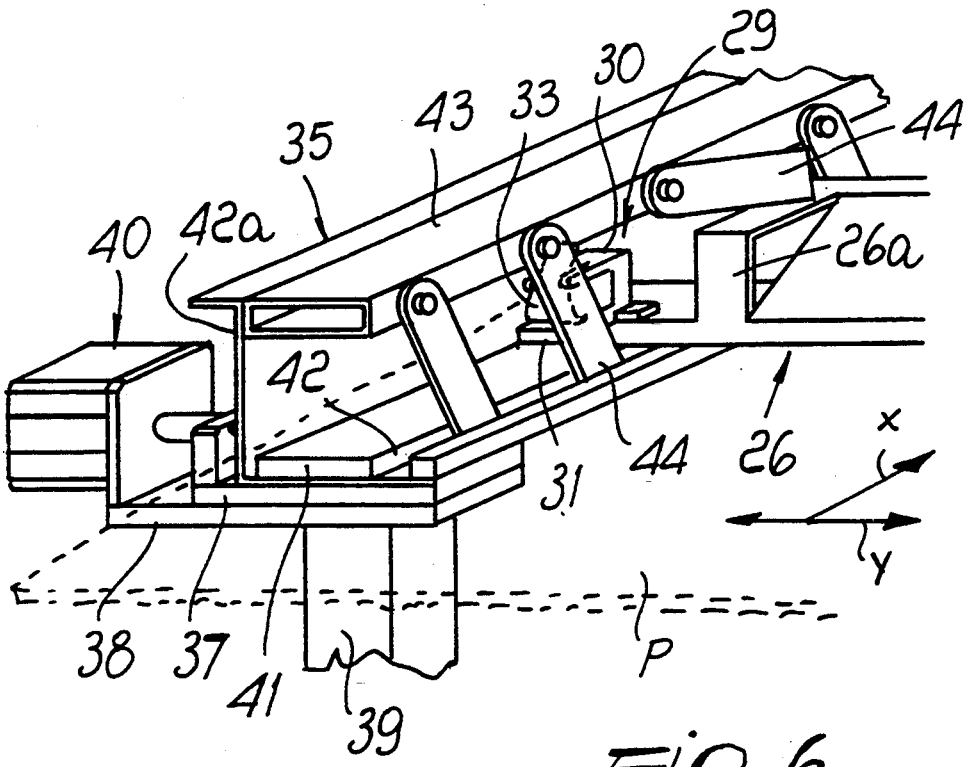
FIG. 6 is a perspective view thereof.

Two profiled elements 35 and 36 extend parallel to the chains 19 and 20 and proximate to the inner side thereof; their opposite ends are rigidly coupled to respective sliders 37 (see FIGS. 5 and 6) which rest on platforms 38 fixed at the top of uprights 39 which extend upwardly from the framework 2. The sliders 37 are connected to pneumatic jacks 40 supported on the platforms 38 and active in direction Y, so that the profiled elements 35 and 36 can be spaced apart and moved mutually closer.

The profiled elements 35 and 36 have a substantially L-shaped cross-section, are symmetrical with respect to a longitudinal centerline plane and have a horizontal face 41, on which a groove 42 is formed, and a vertical face 42*a*, along an edge of which a strip 43 is rigidly coupled and extends above the face 41 in a cantilevered manner.

A plurality of levers 44 is articulated to the strips 43; said levers are equidistantly spaced and oscillate in a longitudinal vertical plane. The levers 44 are actuated by respective springs (not shown), thereby engaging the free ends of the levers 44 in the grooves 42. The purpose of the levers 44 is, as will become apparent hereinafter, to insert the lateral edges of the cloth to be quilted into the grooves 42 and act as second clamps which grip the lateral edges of the cloth to allow to stretch it transversely when the profiled elements 35 and 36 are spaced by actuating the jacks 40.

The cloth is stretched longitudinally by pulling the front edge, gripped by the first clamps 29, while the rear edge is held by a cloth presser bar 45.

As shown by FIG. 8, the cloth presser bar 45 is supported, at its ends, by a pair of jacks 45*a* and 45*b* mounted in the supports 24 so that said bar is arranged above the beam 22. A plurality of U-shaped brackets 46 (FIG. 9) is supported in the bar 45; said brackets surround the bar 45 from below. The brackets 46 are vertically guided by bolts 46*a* which are slideable in slots 46*b* formed in the parallel portions of the brackets and are actuated by springs (not shown) towards the underlying beam 22, so as to elastically clamp the cloth against said beam. The brackets 46 furthermore allow to compensate for the thickness of the chains 19 and 20 when the bar 45 lowers onto the beam 22.

Figure 1:
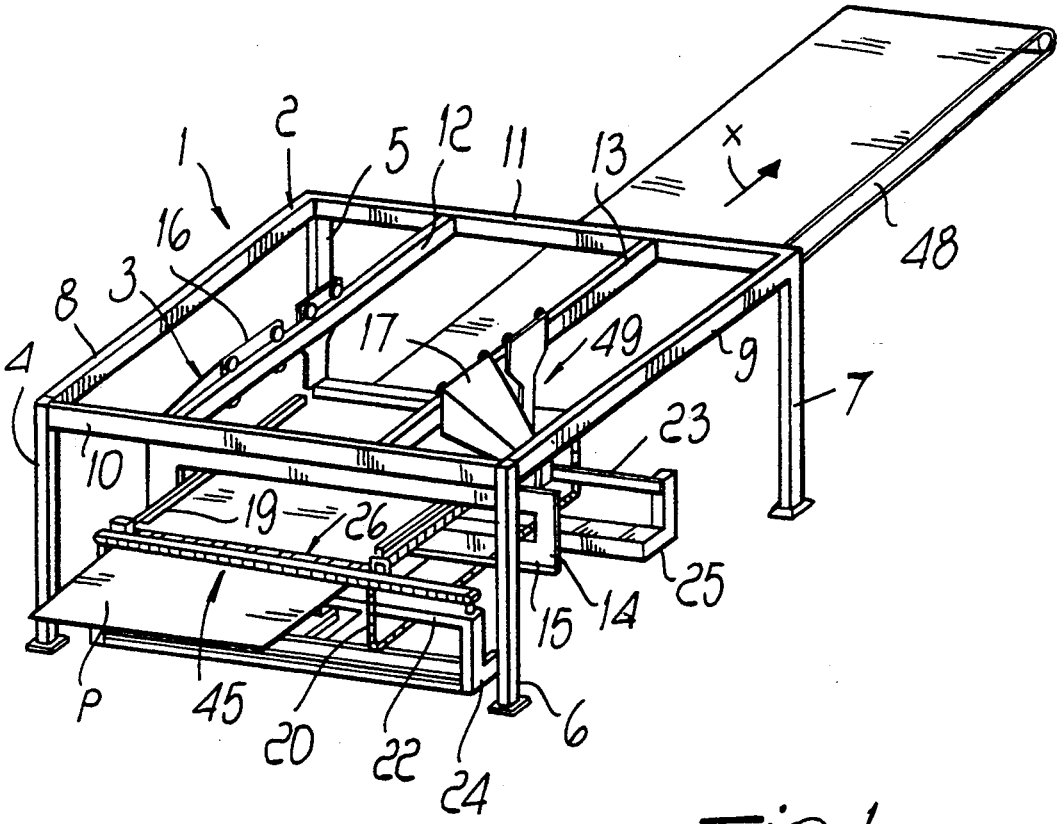
FIG. 1 is a perspective view of a quilting machine equipped with an apparatus according to the present invention.
Figure 2:
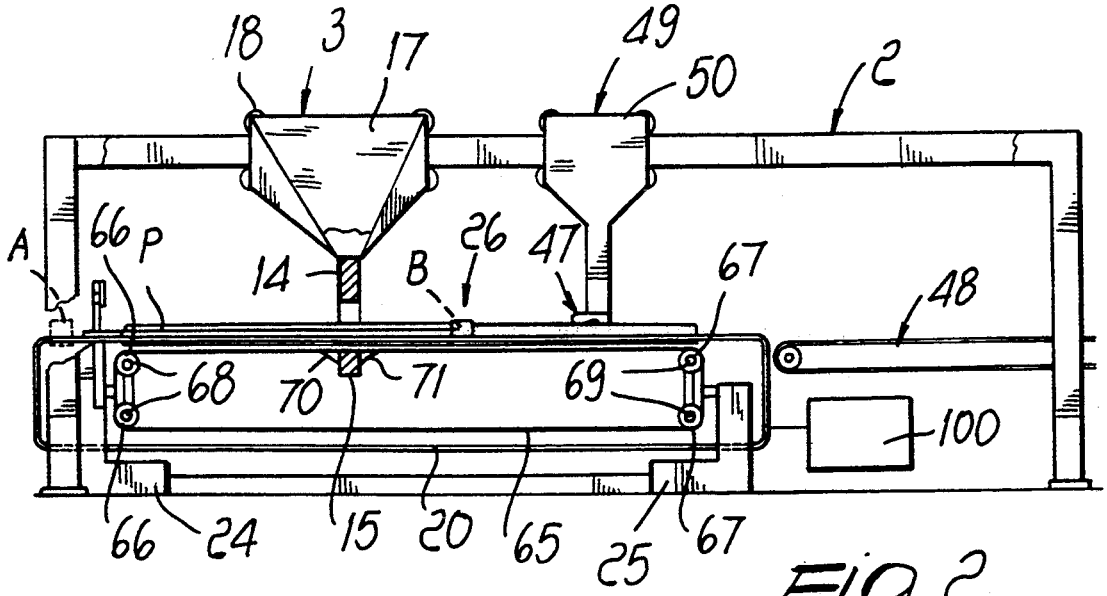
FIG. 2 is a side view of the machine and of the apparatus of FIG. 1.
Figure 4:
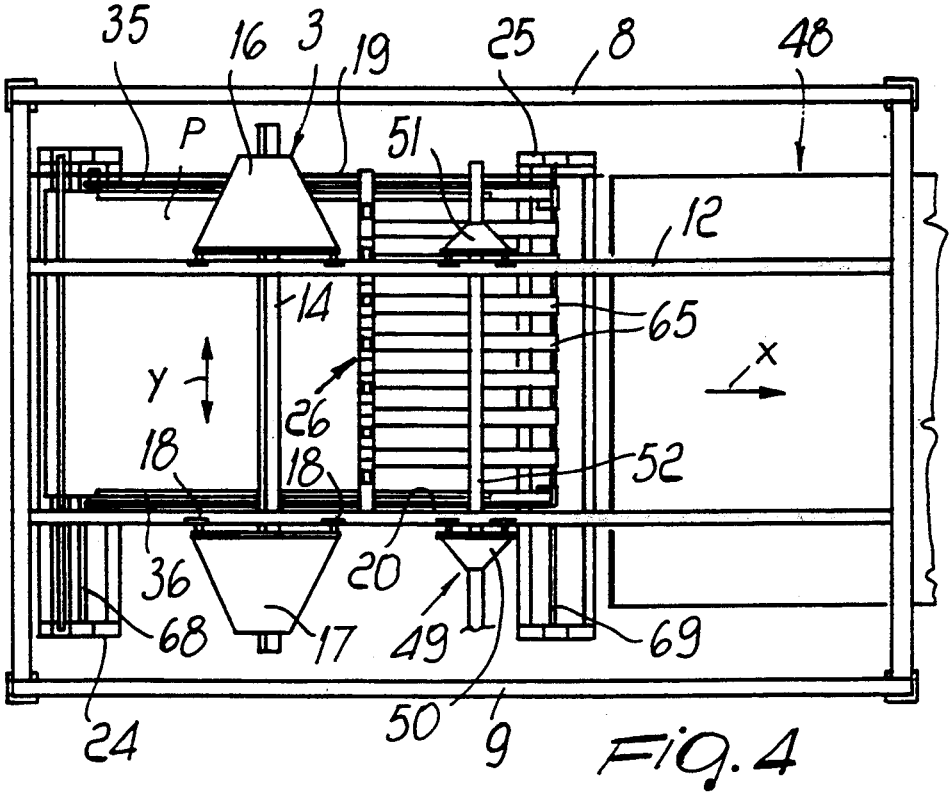
FIG. 4 is a top view thereof.

The described apparatus is completed by a grip element, generally designated by the reference numeral 47, which takes the quilted cloth at a grip position and transfers it onto removal means, constituted by a removal conveyor 48 (FIGS. 2 and 4).

The grip element 47 is supported by a transfer carriage 49 which is slideable on a portion of the same rail 12 and 13 used for the sliding of the carriage 3 which extends above the conveyor 48. The carriage 49 comprises two lateral supports 50 and 51 (see FIGS. 2 and 4) provided with rollers for rolling on the rail 12 and 13. The supports 50 and 51 extend downwards and support a beam 52.

The jaws 53 and 54 of third further clamps 55 are articulated under the beam 52 (see FIGS. *7a–7d*) at the regions between the clamps 29, and constitute as a whole the grip element 47; said third clamps 55 are suitable to grip the front edge of the cloth P which is transferred to them by the first clamps 29 of the bar 26.

The lower jaws 54 are positioned by the abutment of an expansion thereof 56 under the beam 52, so that their end is at a higher level than the portion 27 of the bar 26. The upper jaws 53 are constituted by L-shaped elements actuatable by pneumatic jacks 57 between a position in which they rest below the beam 52 and a position in which they are in contact with the lower jaws 54.

Conveniently, the portion 27 of the bar 26 at the regions between the clamps 29 has an upper face 58 which is shaped like an inverted V (FIG. *7a*) and which, by making contact with the lower jaws 54, allows to guide said jaws below the front edge of the cloth P during the transfer of said edge from the clamps 29 to the clamps 55.

The operation of the described apparatus is as follows. In the initial condition, the bar 26 supporting the clamps 29 is on standby in position A (FIG. 2) upstream of the cloth presser bar 45.

The operator first of all inserts the front edge of the cloth P in the first clamps 29 so that it remains gripped between the levers 33 and the lower brackets 31.

The chains 19 and 20 are then activated and, by moving the bar 26 in direction X, arrange the cloth between the sewing head and the crochet device of the sewing machine. At the same time, the lateral edges of the cloth slide between the second clamps constituted by the levers 44 and the face 41 of the profiled elements 35 and 36 and are pushed into the grooves 42 by the levers 44.

It should be noted that the bar 26, during its movement in direction X, raises the levers 44 (see FIG. 6), which are allowed to fall back by a step 26*a* of the bar in order to produce an impact on the cloth which is sufficient to insert it in the groove 42. It should furthermore be noted that the clamps 29 arranged at the ends of the bar 26 slide outside the levers 44 under the strip 43 to ensure the widening of the cloth up to the vertical walls of the profiled elements 35 and 36.

When the cloth P has been moved into the quilting machine and the bar 26 has reached position B, the jacks 45*a* and 45*b* (FIG. 8) are activated; by lowering the cloth presser bar 45, said jacks block the rear edge of the cloth between the brackets 46 and the underlying beam 22.

Then the jacks 40 (FIGS. 5 and 6) are activated, spacing apart the profiled elements 35 and 36 and stretching the cloth transversely (direction Y). Since the necessary longitudinal stretching (direction X) of the cloth has already been performed by the traction of the bar 26 and by the braking effect of the cloth presser bar 45, the cloth is ready to be quilted. Quilting is performed by moving the sewing machine along the beams 14 and 15 of the carriage 3 and by moving the carriage 3 along the rail 12 and 13 so as to trace a sewing line according to the required path. Once quilting has ended, the cloth is removed. For this purpose, the grip element 47 is moved adjacent to the bar 26 to change the grip of the front edge of the cloth from the clamps 29 to the clamps 55. During this approach step (FIG. *7a*), the lower jaws 54 of the clamps 55 pass between the clamps 29 and are guided (FIG. *7b*) by the inverted-V shape 58 below the front edge of the cloth P (FIG. *7c*). With the further movement of the carriage 47 (FIG. *7d*), the beam 52 acts on the arms 34 of the levers 33, which rise and thus release the front edge of the cloth. At the same time, the jacks 57 are activated and, by acting on the upper jaws 53, block the front edge of the cloth P against the lower jaws 54.

It should be noted that, as soon as the front edge of the cloth is gripped by the clamps 55, the chains 19 and 20 are activated again in the direction X, so that the bar 26 and the clamps 29 reach the starting position A, ready for applying the next cloth to be used.

After gripping the front edge of the cloth P, the element 47 is actuated so as to transfer the cloth P onto the removal conveyor 48 while said cloth is extracted below the levers 44.

Conveniently, while the carriage 47 removes the quilted cloth, the chains 19 and 20 are actuated so as to move the subsequent cloth, which in the meantime has been inserted in the clamps 29 by the operator, into the quilting machine, so as to reduce inactive periods to a minimum. The cycle is then repeated in the above described manner.

The described apparatus is susceptible to numerous technically equivalent modifications and variations.

For example, it is possible to provide disks 59 instead of the levers 44 (FIG. 10); said disks are guided vertically and are loaded downwards by springs 60. FIGS. 11 and 12 illustrate a solution having, on the chains 19 and 20, three equidistant bars 26 for supporting clamps 29 so that when one bar leaves position B another bar occupies position A. The quilted cloth can be released by the clamps 29 onto a surface 61 lying below the chains 19 and 20 or can be transferred onto a lateral surface 62 by a clamp 63 which grips its rear edge.

Figure 3:
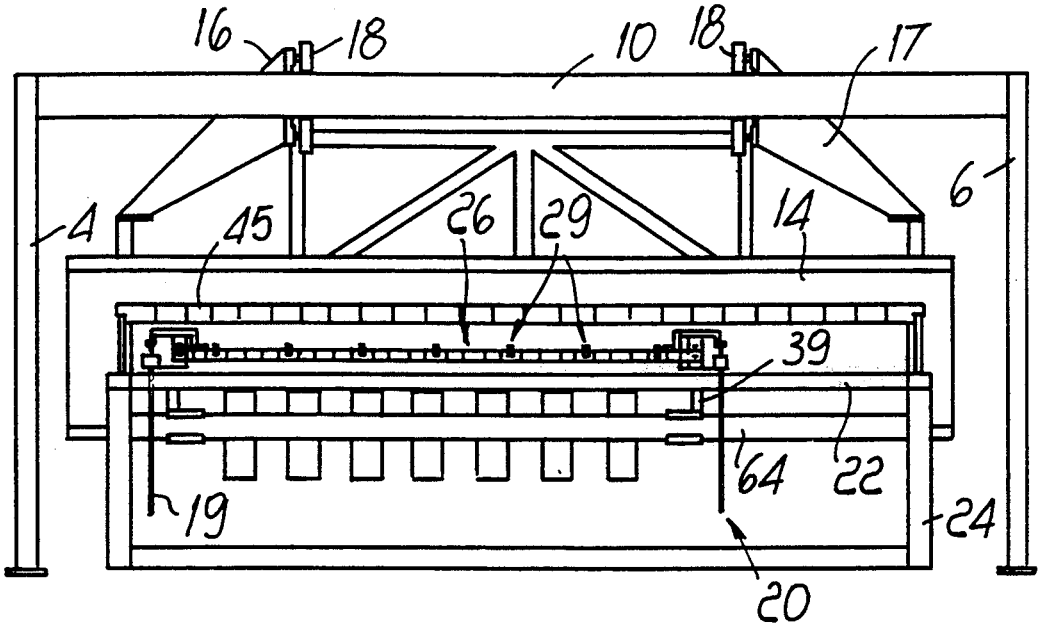
FIG. 3 is a front view thereof.

In particular, it is possible to widen or reduce the distance between the profiled elements 35 and 36 according to the width of the cloth. For this purpose, the uprights 39 which supports the profiled elements 35 and 36 can be adjusted along transverse beams 64 of the framework (FIG. 3). Naturally, one of the chains 19 and 20 is also adjustable in its distance with respect to the other one, whereas the bar 26 which supports the clamps 29 is telescopically extendable to adapt to the width of the cloth.

Advantageously, the apparatus has a cloth supporting surface to prevent said cloth from sagging under its own weight.

Said surface is constituted by the upper horizontal portions of a plurality of belts 65 (FIG. 4) which are parallel to the chains 19 and 20. The belts 65 are wound in a rectangular loop (FIG. 2) around pulleys 66 and 67 which are mounted on shafts 68 and 69 supported by the shoulders 24 and 25, and the ends 70 and 71 of their upper horizontal portions are rigidly coupled upstream and downstream of the beam 15 supporting the crochet devices.

In this manner, the belts 65 move together with the carriage 3 and support the cloth during quilting.

We claim:

1. Apparatus for feeding a quilting machine with a cloth to be quilted, comprising: a pair of flexible elements, each closed in a loop along vertical planes, said flexible elements having two upper horizontal and parallel portions movable in a direction X; at least one bar fixed transversely to said flexible elements and provided with first clamps for gripping a front edge of the cloth to be quilted; and means for actuating said flexible elements for the advancement of the cloth in said direction X from a position for gripping the front edge of the cloth to be quilted to a quilting position and from said quilting position to a position in which said clamps release said cloth on removal means; second clamps being arranged at the sides of said horizontal portions of said flexible elements in order to grip the lateral edges of said cloth and retain it in said quilting position.

2. Apparatus according to claim 1, further comprising a stationary beam which extends transversely below the cloth and a bar which is parallel to said beam above the cloth and is provided with movable elements in a downward direction, said bar being movable in a downward direction against said beam by means of jacks so as to retain a rear edge of the cloth in said quilting position between said elements and said beam.

3. Apparatus according to claim 1, further comprising rails overlying said flexible elements, a carriage slideable along said rails in a direction parallel to said flexible elements and provided with third clamps, said carriage being actuated between a grip position, in which said third clamps swap with said first clamps to grip the front edge of the cloth, and a position for releasing said cloth onto a removal conveyor.

4. Apparatus according to claim 3, wherein each one of the first clamps comprises a pair of superimposed brackets including an upper bracket and a lower bracket, a lever being articulated to the upper bracket, said lever abutting against the lower bracket and being shaped so as to form a guide for the insertion of the front edge of the cloth to be quilted and for the retention thereof, said lever being provided with an arm which cooperates with said carriage so as to open said first clamps when said third clamps are actuated so as to grip said front edge.

5. Apparatus according to claim 3, wherein said carriage for supporting said third clamps comprises a beam which is transverse to the direction of advancement of the cloth and lies above the upper portions of said flexible elements, superimposed pairs of jaws being articulated below said beam, said jaw pairs constituting said third clamps and being aligned with respect to said first clamps so that they can pass between them, the lower jaws being arranged at such a level as to pass above said at least one bar provided with said first clamps during the movement of said carriage into the position for gripping the front edge of the cloth, the upper jaws being constituted by L-shaped elements which can be actuated by pneumatic jacks into said grip position to clamp said front edge against the lower jaws.

6. Apparatus according to claim 1, further comprising supports and horizontal guides, said supports being located adjacent said flexible elements, said horizontal guides being connected to said supports, wherein said flexible elements are constituted by chains, the upper portions whereof run in said horizontal guides.

7. Apparatus according to claim 1, wherein said second clamps comprise two profiled elements having a substantially L-shaped cross-section and parallel to said horizontal portions of said flexible elements, said profiled elements being arranged mirror-symmetrically, each profiled element having a horizontal face, on which a longitudinal groove is formed, and a vertical face to which a plurality of levers is articulated, said levers oscillating in a plane which extends along said groove and constituting said second clamps, said levers engaging, with their ends, said grooves in order to retain the lateral edges of said cloth.

8. Apparatus according to claim 7, wherein said profiled elements are rigidly coupled to sliders guided at right angles to them and actuated by pneumatic jacks so as to space said profiled elements in order to stretch said cloth transversely during quilting.

9. Apparatus according to claim 7, wherein the first clamps are arranged at an opposite end of said bar with respect to said third clamps, said first clamps being slideable along said bar externally of said second levers for retaining the lateral edges of the cloth.

10. Apparatus according to claim 1, further comprising a plurality of parallel belts having opposite ends, upper horizontal portions defined by said plurality of parallel belts, a carriage for supporting a sewing machine, and a surface for supporting the cloth defined by said upper horizontal portions, said plurality of parallel belts each being closed in a loop around said pulleys, said opposite ends of said plurality of parallel belts being rigidly coupled to said carriage for supporting said sewing machine for quilting said cloth.

* * * * *